US006025102A

United States Patent [19]

Pai et al.

[11] Patent Number: 6,025,102

[45] Date of Patent: Feb. 15, 2000

[54] ELECTROPHOTOGRAPHIC IMAGING MEMBER

[75] Inventors: Damodar M. Pai, Fairport; John F. Yanus, Webster; Timothy J. Fuller, Pittsford; Merlin E. Scharfe, Penfield; Paul J. DeFeo, Sodus Point; Markus R. Silvestri, Fairport, all of N.Y.

[73] Assignee: Xerox Corporation, Stamford, Conn.

[21] Appl. No.: 08/914,643

[22] Filed: Aug. 19, 1997

[51] Int. Cl.[7] ..... G03G 5/047

[52] U.S. Cl. ..... 430/58.8; 430/58.75; 430/56; 430/133

[58] Field of Search ..... 430/59, 133, 58.75, 430/58.8, 56

[56] References Cited

U.S. PATENT DOCUMENTS

| | | | |
|---|---|---|---|
| 4,621,009 | 11/1986 | Lad | 428/216 |
| 4,871,634 | 10/1989 | Limburg et al. | 430/54 |
| 4,983,481 | 1/1991 | Yu | 430/59 |
| 5,167,987 | 12/1992 | Yu | 427/171 |
| 5,413,810 | 5/1995 | Mastalski et al. | 427/171 |
| 5,698,359 | 12/1997 | Yanus et al. | 430/132 |
| 5,728,498 | 3/1998 | Yanus et al. | 430/59 |

*Primary Examiner*—Christopher D. Rodee

[57] ABSTRACT

A flexible electrophotographic imaging member including a supporting substrate coated with at least one imaging layer comprising charge transport material free of long chain alkyl carboxylate groups and a small amount of a different second hole transporting material containing at least two long chain alkyl carboxylate groups dissolved or molecularly dispersed in a film forming binder and coated from a mixture of solvents containing low boiling component and a small concentration of high boiling solvent. Preferably, the flexible electrophotographic imaging member is free of an anticurl backing layer, the imaging member comprising a supporting substrate uncoated on one side and coated on the opposite side with at least a charge generating layer and a charge transport layer containing comprising a first charge transport material and a small amount of a different second hole transporting material containing at least two long chain alkyl carboxylate groups dissolved or molecularly dispersed in a film forming binder and coated from a mixture of solvents containing low boiling component and a small concentration of high boiling solvent.

21 Claims, No Drawings

ELECTROPHOTOGRAPHIC IMAGING MEMBER

BACKGROUND OF THE INVENTION

This invention relates in general to electrostatography and, more specifically, to an electrostatographic imaging member having a charge transport layer comprising a first charge transport material and a small amount of a different second transporting material containing at least two long chain alkyl carboxylate groups, the layer being coated from a mixture of a low boiling solvent and a high boiling solvent.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electrons or holes and injecting the photogenerated electrons or holes into the charge transport layer. The charge transport layer in this embodiment, of course, must be capable of supporting the injection of photogenerated electrons from the photoconductive layer and transporting the electrons through the charge transport layer. Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive materials exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous dispersions of conductive material in binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

If a flat, biaxially oriented polyethylene terephthalate (e.g. 3 mil thick PET) sheet is solvent coated with an imaging layer, for example a solution of 50 percent by weight polycarbonate (e.g. Makrolon) and 50 percent by weight aromatic diamine dissolved in a solvent to form a charge transport layer (CTL) about 1 mil thick, the multilayer structure tends to curl upon drying. This is due to the dimensional contraction of the applied (CTL) coating relative to the PET substrate from the point in time when the applied (CTL) coating solidifies and adheres to the underlying surface. The solidification point is the glass transition temperature (Tg) of applied coating. Once this solidification point is reached, further evaporation of coating solvent and/or cooling below Tg causes continued shrinking of the applied coating layer due to volume contraction resulting from removal of additional solvent and/or differential thermal contraction will cause the coated sheet to curl toward the applied layer because the PET substrate undergoes smaller dimensional changes. This relative contraction occurs isotropically, i.e., in three-dimensions. In other words, from the point in time when the applied coating has reached the Tg and is anchored at the interface with the underlying support layer, continued shrinking of the applied coating causes dimensional decreases in the applied coating which in turn builds up internal tension stress in the two dimensions constrained by adhesion to the substrate and, therefore, forces the entire coated structure to curl toward the dried applied coating. If the coated article has a circular shape, the curled structure will resemble a bowl. If the Tg of the coated CTL layer is about 50 degrees C. above the operating temperature of the imaging member the relative shrinkage is about 0.6 percent.

Curling is undesirable for several reasons. First, because many of the electrophotographic imaging process depend critically on the spacing between the component and the imaging member; any variation in the flatness adversely affect the quality of the ultimate developed images. For example, non-uniform charging distances may be manifested as variations in the electrostatic latent images. Also the built-in stress weakens the adhesion between the layers, leading to adhesion failures. Moreover, the additional stress combined with the stress from constant flexing of multilayered photoreceptor belts during cycling can cause stress cracks to form due to fatigue and an earlier failure. These cracks print out on the final electrophotographic copy. Premature failure due to fatigue prohibits use of these belts in designs utilizing small roller sizes (e.g. 20 mm or smaller) for effective auto paper stripping. Note that the stretching of the coated layer on a 20 mm roll is approximately equal to 0.6% hence the stress is twice what it would be without the built in stress. In other words, flexing a belt with a built in 0.5 percent shrinkage stress on a 20 mm roll is equivalent to flexing an unstressed belt around a 12 mm roll.

The curl can be counteracted by applying a coating to the underside of the imaging member, i.e. the side of the supporting substrate opposite the electrically active layer or layers. However, such coating requires an additional coating step on a side of the substrate opposite from the side where all the other coatings are applied. This additional coating operation normally requires that a substrate web be unrolled an additional time merely to apply the anticurl layer. Also, many of the solvents utilized to apply the anti-curl layer require additional steps and solvent recovery equipment to minimize solvent pollution of the atmosphere. Further, equipment required to apply the anti-curl coating must be cleaned with solvent and refurbished from time to time. The additional coating operations raise the cost of the photoreceptor, increase manufacturing time, and decrease production throughput. Also the extra coating decreases production yield by, for example, increased likelihood that the photoreceptor will be damaged by the additional handling. Furthermore, the anticurl coating does not eliminate the built in stress and the problems that it causes, such as premature failure with cycling. Also, other difficulties have been encountered with these anti-curl coatings. For example, photoreceptor curl can sometimes still be encountered due to a decrease in anticurl layer thickness resulting from wear in as few as 1,500 imaging cycles when the photoreceptor belt is exposed to stressful operating conditions of high temperature and high humidity. The curling of the photoreceptor is inherently caused by internal stress build-up in the electrically active layer or layers of the photoreceptor which promotes dynamic fatigue cracking, thereby shortening the mechanical life of the photoreceptor. Further, the anticurl coatings occasionally separate from the substrate during extended machine cycling and render the photoconductive imaging member unacceptable for forming quality images. Anticurl layers will also occasionally delaminate due to poor adhesion to the supporting substrate. Moreover, in electrophotographic imaging systems where transparency of the substrate and anticurl layer are necessary for rear exposure erase to activating electromagnetic radiation, any reduction of transparency due to the presence of an anticurl layer will cause a reduction in performance of the photoconductive imaging member. Although the reduction in transparency may in some cases be compensated by increasing the intensity of the electromagnetic radiation, such increase is generally undesirable due to the amount of heat generated as well as the greater costs necessary to achieve higher intensity.

Further, the built in mechanical stresses which, when perturbed by wear, results in distortions which resemble ripples. These ripples are the most serious photoreceptor related problem in advanced precision imaging machines which demand precise tolerances. When ripples are present, different segments of the imaging surface of the photoconductive member are located at different distances from charging devices, developer applicators, toner image receiving members and the like during the electrophotographic imaging process thereby adversely affecting the quality of the ultimate developed images. For example, non-uniform charging distances can be manifested as variations in high background deposits during development of electrostatic latent images. It is theorized that since the anticurl backing layer is usually composed of material that is less wear resistant than the adjacent substrate layer, it wears rapidly during extended image cycling, particularly when supported by stationary skid plates. This wear is nonuniform and leads to the distortions which resemble ripples and also produces debris which can form undesirable deposits on sensitive optics, corotron wires and the like.

Another property of significance in multilayer devices is the charge carrier mobility in the transport layer. Charge carrier mobilities determine the velocities at which the photoinjected carriers transit the transport layer. To achieve maximum discharge or sensitivity for a fixed exposure, the photoinjected carriers must transit the transport layer before the imagewise exposed region of the photoreceptor arrives at the development station. To the extent the carriers are still in transit when the exposed segment of the photoreceptor arrives at the development station, the discharge is reduced and hence the contrast potentials available for development are also reduced. For greater charge carrier mobility capabilities, it is normally necessary to increase the concentration of the active small molecule transport compound dissolved or molecularly dispersed in the binder. Phase separation or crystallization sets an upper limit to the concentration of the transport molecules that can be dispersed in a binder. One way of increasing the solubility limit of the transport molecule is to attach long alkyl groups on to the transport molecules. However, these alkyl groups are "inactive" and do not transport charge. For a given concentration of the transport molecules, these side chains actually reduce the charge carrier mobility. A second factor that reduces the charge carrier mobilities is the dipole content of the charge transport molecules, their side groups as well as that of the binder in which the molecules are dispersed. One prior technique for reducing the curl involves an imaging member comprising hole transporting material containing at least two long chain alkyl carboxylate groups dissolved or molecularly dispersed in a film forming binder. The prior technique suggested the use of these molecules containing long chain alkyl carboxylate groups dispersed in a binder or in combination with a conventional hole transport molecule. However, when employed in combination with a conventional transport molecule, the concentration of the molecule with the long alkyl carboxylate groups had to be considerably greater than 15 percent by weight in order to eliminate curl. Although curl is eliminated and these devices can be used in electrophotography, high speed electrophotography requires higher charge carrier mobilities. Use of a large concentration of transporting material containing at least two long chain alkyl carboxylate groups results in a drop in charge carrier mobilities because of the "inactive" long chains required to reduce curl as well as the high dipole content of these long alkyl carboxylate groups.

INFORMATION DISCLOSURE STATEMENT

U.S. Pat. No. 5,167,987 to Yu, issued Dec. 1, 1992—A process for fabricating an electrophotographic imaging member is disclosed comprising providing a flexible substrate comprising a solid thermoplastic polymer, forming an imaging layer coating comprising a film forming polymer on the substrate, heating the coating, cooling the coating, and applying sufficient predetermined biaxial tensions to the substrate while the imaging layer coating is at a temperature greater than the glass transition temperature of the imaging layer coating to substantially compensate for all dimensional thermal contraction mismatches between the substrate and the imaging layer coating during cooling of the imaging layer coating and the substrate, removing application of the biaxial tension to the substrate, and cooling the substrate whereby the final hardened and cooled imaging layer coating and substrate are substantially free of stress and strain.

U.S. Pat. No. 4,983,481 to Yu, issued Jan. 8, 1991—An imaging member without an anticurl layer is disclosed having improved resistance to curling. The imaging member comprises a flexible supporting substrate layer, an electrically conductive layer, an optional adhesive layer, a charge generator layer and a charge transport layer, the supporting layer having a thermal contraction coefficient substantially identical to the thermal contraction coefficient of the charge transport layer.

U.S. Pat. No. 4,621,009 to Lad, issued Nov. 4, 1986—A coating composition is disclosed for application onto a plastic film to form a coating capable of bonding with xerographic toner. The coating composition consists of a resin binder, preferably a polyester resin, a solvent for the resin binder, filler particles, and at least one crosslinking and antistatic agent. The coating composition is applied to a polyester film, preferably a film of polyethylene terephthalate, under conditions sufficient to fix toner onto the coating without wrinkling.

U.S. Pat. No. 4,871,634 to W. Limburg et al., issued Oct. 3, 1989—A hydroxy arylamine compound, represented by a specific formula, is disclosed as employable in photoreceptors.

CROSS REFERENCE TO COPENDING APPLICATIONS

Copending application Ser. No. 08/722,352, entitled ELECTROPHOTOGRAPHIC IMAGING MEMBER HAVING AN IMPROVED CHARGE TRANSPORT LAYER, to J. Yanus et al., filed Sept. 27, 1996, now U.S. Pat. No. 5,228,498, issued Mar. 17, 1998—A flexible electrophotographic imaging member is disclosed coated with at least one imaging layer comprising a hole transporting material containing at least two long chain alkyl carboxylate groups dissolved or molecularly dispersed in a film forming binder. The imaging member may be free of an anticurl backing layer.

Copending application Ser. No. 08/914,565, now U.S. Pat. No. 5,863,685 to P. DeFeo et al entitled "ELECTROPHTOGRAPHIC IMAGING MEMBER HAVING AN IMPROVED CHARGE TRANSPORT LAYER", filed Aug. 19, 1997—A flexible electrophotographic imaging member is disclosed including a supporting substrate coated with at least one imaging layer comprising hole transporting material containing a hole transporting molecule dissolved or molecularly dispersed in a film forming binder and coated from a mixture of solvents comprising a low point boiling solvent and a small concentration of high boiling point solvent. Preferably, the flexible electrophotographic imaging member is free of an anticurl backing layer, the imaging member comprising a supporting substrate uncoated on one side and coated on the opposite side with at least a charge generating layer and a charge transport layer containing hole transporting material dissolved or molecularly dispersed in a film forming binder and coated from a mixture of solvents containing a low boiling point solvent and a small concentration of high boiling point solvent.

Copending application Ser. No. 08/782,236, entitled HIGH SENSITIVITY VISIBLE AND INFRARED PHOTORECEPTOR, to J. Yanus et al., filed Jan. 13, 1997, now U.S. Pat. No. 5,698,359, issued Dec. 16,1997—A process is disclosed for fabricating an electrophotographic imaging member including providing a supporting substrate, forming a charge generating layer on the substrate, applying a coating composition to the charge generating layer, the coating composition including a film forming charge transporting polymer dissolved in methylene chloride and a solvent selected from the group consisting of 1,2 dichloroethane, 1,1,2 trichloroethane or mixtures thereof, the charge transporting polymer having a backbone comprising active arylamine moieties along which charge is transported, and drying the coating to form a charge transporting layer.

Thus, the characteristics of many electrostatographic imaging members comprising a supporting substrate coated on one side with at least one photoconductive layer and coated or uncoated on the other side with an anticurl layer exhibit deficiencies which are undesirable in automatic, cyclic electrostatographic copiers, duplicators, and printers.

BRIEF SUMMARY OF THE INVENTION

It is an object of the invention to provide an electrostatographic imaging member which overcomes the above-noted disadvantages.

It is another object of this invention to provide an electrostatographic imaging member process with improved resistance to curling.

It is another object of this invention to provide an electrostatographic imaging member which is less complex.

It is another object of this invention to provide an electrostatographic imaging member capable of being fabricated with a simpler coating process.

It is another object of this invention to provide an electrostatographic imaging member free of an anticurl backing layer.

It is another object of this invention to provide an electrostatographic imaging member free of an anticurl backing layer and which can yet be operated at high speed.

It is still another object of this invention to provide an electrostatographic imaging member having improved resistance to the formation of ripples in the form of crossweb sinusoidal deformations when subjected to extended image cycling.

It is another object of this invention to provide an electrostatographic imaging member exhibiting an increased cycling life.

The foregoing objects and others are accomplished in accordance with this invention by providing a flexible electrophotographic imaging member including a supporting substrate coated with at least one imaging layer comprising charge transport material free of long chain alkyl carboxylate groups and a small amount of a different second hole transporting material containing at least two long chain alkyl carboxylate groups dissolved or molecularly dispersed in a film forming binder and coated from a mixture of solvents containing low boiling component and a small concentration of high boiling solvent. Preferably, the flexible electrophotographic imaging member is free of an anticurl backing layer, the imaging member comprising a supporting substrate uncoated on one side and coated on the opposite side with at least a charge generating layer and a charge transport layer containing comprising a first charge transport material and a small amount of a different second hole transporting material containing at least two long chain alkyl carboxylate groups dissolved or molecularly dispersed in a film forming binder and coated from a mixture of solvents containing low boiling component and a small concentration of high boiling solvent.

The term "substrate" is defined herein as a flexible member comprising a solid thermoplastic polymer or a metallic substrate that is uncoated or coated on the side to which a charge generating layer and a charge transport layer are to be applied and free of any anticurl backing layer on the opposite side.

Generally, the imaging member comprises a flexible supporting substrate having an electrically conductive surface and at least one imaging layer. The imaging layer may be a single layer combining the charge generating and charge transporting functions or these functions may be separated, each in its own optimized layer. The flexible supporting substrate layer having an electrically conductive surface may comprise any suitable flexible web or sheet comprising a solid thermoplastic polymer. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient mechanical strength to support the electrophotoconductive layer or layers. The flexible electrically conductive layer, which may comprise the entire supporting substrate or merely be present as a coating on an underlying flexible web member, may comprise any suitable electrically conductive material. Typical electrically conductive materials include, for example, aluminum, titanium, nickel, chromium, brass, gold, stainless steel and the like. These conductive materials as well as others such as copper iodide, carbon black, graphite and the like may be dispersed in a solid thermoplastic polymer. The flexible conductive layer may vary in thickness over substantially wide ranges depending on the desired use of the electrophotoconductive member. Accordingly, the conductive layer can generally range in thicknesses of from about 50 Angstrom units to about 150 micrometers. When a highly flexible photoresponsive imaging device is desired, the thickness of the conductive layer may be between about 100 Angstrom units to about 750 Angstrom units. Any suitable underlying flexible support layer of any suitable material containing a thermoplastic film forming polymer alone or a thermoplastic film forming polymer in combination with other materials may be used. Typical underlying flexible support layers comprise film forming polymers include, for example, polyethylene terepthalate, polyimide, polysulfone, polyethylene naphthalate, polypropylene, nylon, polyester, polycarbonate, polyvinyl fluoride, polystyrene and the like. Specific examples of supporting substrates include polyethersulfone (Stabar S-100, available from ICI), polyvinyl fluoride (Tedlar, available from E. I. DuPont de Nemours & Company), polybisphenol-A polycarbonate (Makrofol, available from Mobay Chemical Company) and amorphous polyethylene terephthalate (Melinar, available from ICI Americas, Inc.).

The coated or uncoated flexible supporting substrate layer is highly flexible and may have any number of different configurations such as, for example, a sheet, a scroll, an endless flexible belt, and the like. Preferably, the insulating web is in the form of an endless flexible belt and comprises a commercially available biaxially oriented polyethylene terephthalate substrate known as Melinex 442, available from ICI.

If desired, any suitable charge blocking layer may be interposed between the conductive layer and the photogenerating layer. Some materials can form a layer which functions as both an adhesive layer and charge blocking layer. Typical blocking layers include polyvinylbutyral, organosilanes, epoxy resins, polyesters, polyamides, polyurethanes, silicones and the like. The polyvinylbutyral, epoxy resins, polyesters, polyamides, and polyurethanes can also serve as an adhesive layer. Adhesive and charge blocking layers preferably have a dry thickness between about 20 Angstroms and about 2,000 Angstroms.

The silane reaction product described in U.S. Pat. No. 4,464,450 is particularly preferred as a blocking layer material because its cyclic stability is extended. The entire disclosure of U.S. Pat. No. 4,464,450 is incorporated herein by reference. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof.

Generally, satisfactory results may be achieved when the reaction product of a hydrolyzed silane and metal oxide layer forms a blocking layer having a thickness between about 20 Angstroms and about 2,000 Angstroms.

In some cases, intermediate layers between the blocking layer and the adjacent charge generating or photogenerating layer may be desired to improve adhesion or to act as an electrical barrier layer. If such layers are utilized, they preferably have a dry thickness between abut 0.01 micrometer to about 5 micrometers. Typical adhesive layers include film forming polymers such as polyester, polyvinylbutyral, polyvinylpyrolidone, polyurethane, polymethyl methacrylate and the like.

Typically, the electrophotoconductive imaging member of this invention comprises a supporting substrate layer, a metallic conductive layer, a charge blocking layer, an optional adhesive layer, a charge generator layer, a charge transport layer. The electrophotoconductive imaging member of this invention is preferably free of any anti-curl layer on the side of the substrate layer opposite the electrically active charge generator and charge transport layers, although a back coating may be optionally present to provide some other benefit such as increased traction and the like. Any suitable charge generating or photogenerating material may be employed as one of the two electrically operative layers in the multilayer photoconductor of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. No. 4,265,990, U.S. Pat. No. 4,233,384, U.S. Pat. No. 4,471,041, U.S. Pat. No. 4,489,143, 4,507,480, U.S. Pat. No. 4,306,008, 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is important that there be particle-o-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly(N-vinyl carbazole), a photoconductive material need only to comprise about 1 percent or less by volume of the binder layer with no limitation on the maximum amount of photoconductor in the binder layer. Generally for generator layers containing an electrically active matrix or binder such as poly(N-vinyl carbazole) or poly(hydroxyether), from about 5 percent by volume to about 60 percent by volume of the photogenerating pigment is dispersed in about 95 percent by volume to about 40 percent by volume of binder, and preferably from about 7 percent to about 30 percent by volume of the photogenerating pigment is dispersed in from about 93 percent by volume to about 70 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The relatively thick active charge transport layer, in general, comprises a mixture of at least two different charge transport molecules. A first of these two charge transport molecules is a charge transport molecule free of long chain alkyl carboxylate groups and a second of these charge transport molecules, present in a smaller concentration, is a different hole transporting molecule containing at least two long chain alkyl carboxylate groups. These charge transport molecules are dissolved or molecularly dispersed in a film forming binder. The term "dissolved" as employed herein is defined as forming a solution in which the small molecules are dissolved in the film forming binder to form a homogeneous phase. The expression "molecularly dispersed" as used herein is defined as a charge transporting small molecule dispersed in the polymer, the small molecules being dispersed in the polymer on a molecular scale. The expression charge transporting "small molecule" is defined herein as a monomer that allows the free charge photogenerated in the transport layer to be transported across the transport layer. The charge transport layer is formed by applying a coating solution of the charge transport molecules and film forming binder dissolved in a mixture of a high boiling solvent and a low boiling solvent. The charge transport layer should also be capable of supporting the injection of photogenerated holes and electrons from the charge transport layer and allowing the transport of these holes or electrons through the charge transport layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the charge generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

The active charge transport layer must contain a mixture of at least a conventional hole transporting molecule free of long chain alkyl carboxylate groups and a small concentration of a different hole transporting material containing at least two long chain alkyl carboxylate groups dissolved or molecularly dispersed in a film forming binder. This mixture of hole transporting materials make the polymeric film forming materials electrically active. The mixture of a first hole transporting molecule free of long chain alkyl carboxylate groups and a smaller concentration of a second different charge transport molecule containing at least two long chain alkyl carboxylate are added to film forming charge transporting polymeric materials or added to film forming polymeric materials which are incapable of supporting the injection of photogenerated holes from the generation material and incapable of allowing the transport of these holes therethrough. Addition of a mixture of a first hole transporting-molecule free of long chain alkyl carboxylate groups and a smaller concentration of second different charge transport molecule containing at least two long chain alkyl carboxylate will convert an electrically inactive film forming polymeric material to a material capable of supporting the injection of photogenerated holes from the generation material and capable of allowing the transport of these holes through the active layer in order to discharge the surface charge on the active layer.

The hole transporting materials containing at least two long chain alkyl carboxylate groups is derived from a charge transporting reactant selected from the group consisting of tertiary amine containing molecules and the like and mixtures thereof. Preferred charge transporting materials of this invention can be represented by the following formula:

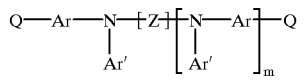

wherein:

m is 0 or 1,

Z is selected from the group consisting of:

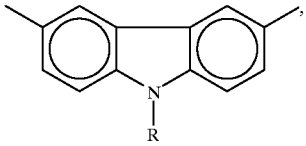

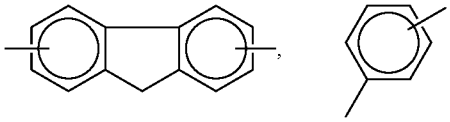

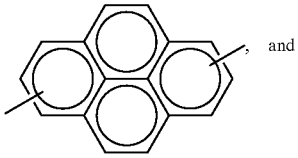

and

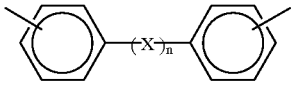

n is 0 or 1,

Ar is selected from the group consisting of:

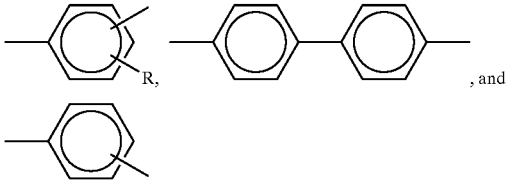

R is selected from the group consisting of $—CH_3$, $—C_2H_5$, $—C_3H_7$, and $—C_4H_9$, Ar' is selected from the group consisting of:

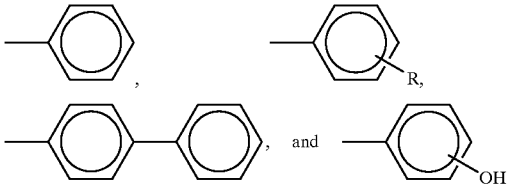

X is selected from the group consisting of:

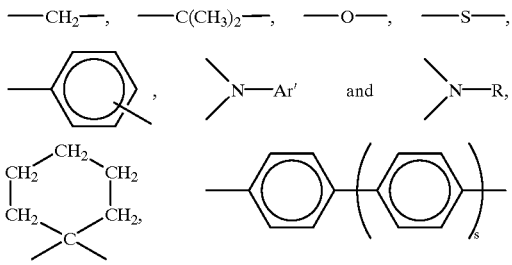

s is 0,1 or 2, and

Q is represented by the formula:

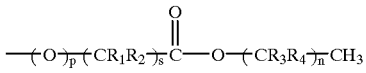

wherein:

p is 1 or 0

$R_1$, $R_2$, $R_3$, $R_4$ are independently selected from —H, $—CH_3$,$—(CH_2—)$,$CH_3$, $—CH(CH_3)_2$,$-C(CH_3)_3$ wherein v is 1 to 10, and s and n are independently selected from 0 to 10.

A preferred charge transporting unit that ultimately attaches to long chain alkyl carboxylate groups is an arylamine. Preferably, the arylamine is represented by the following formula:

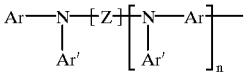

wherein Ar, Ar', Z and h are as defined above with reference to the formula representing the preferred hole transporting materials containing at least two long chain alkyl carboxylate groups.

A preferred charge transporting material for admixing with the hole transporting material containing at least two long chain alkyl carboxylate groups is an aromatic amine compound having the general formula:

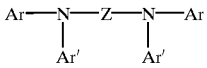

wherein:

Z is selected from the group consisting of:

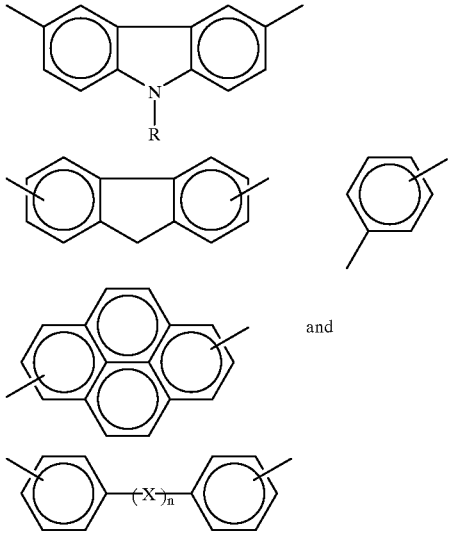

n is 0 or1,

Ar is selected from the group consisting of:

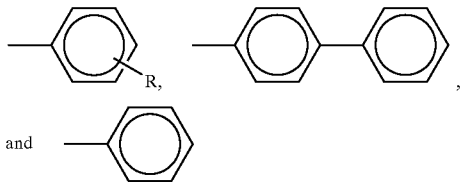

R is selected from the group consisting of —$CH_3$, —$C_2H_5$, —$C_3H_7$, and —$C_4H_9$, Ar' is selected from the group consisting of:

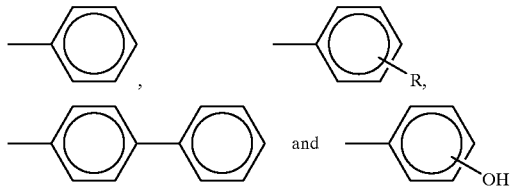

X is selected from the group consisting of:

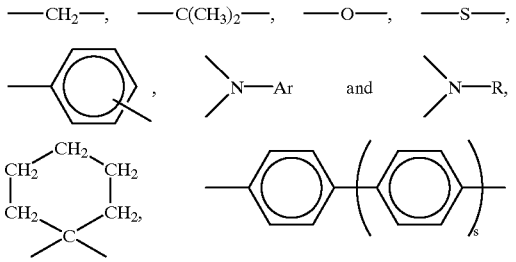

s is 0, 1 or 2.

Examples of the first hole transporting molecule free of long chain alkyl carboxylate groups include charge transporting aromatic amines free of long chain alkyl carboxylate groups for admixing with the second different transporting material containing at least two long chain alkyl carboxylate groups include, for example, triphenylmethane, bis(4-diethylamine-2-methylphenyl) phenylmethane; 4'4"-bis (diethylamino)-2',2"-dimethyltriphenyl-methane, N,N'-bis (alkylphenyl)-[1,1'-biphenyl]4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)4,4'-diamine, and the like. Unlike the second different transporting material containing at least two long chain alkyl carboxylate groups, these first hole transporting molecule are free of long chain alkyl carboxylate groups. The charge transport layer of the photoreceptor of this invention may contain between about 37 percent by weight and about 50 percent by weight of the first hole transporting material free of long chain alkyl carboxylate groups, between about 3 percent and about 10 percent by weight of the second different charge transport molecule containing at least two long chain alkyl carboxylate and between about 60 percent by weight and about 40 percent by weight of the film forming binder, all based on the total weight of the transport layer after drying. In all of the above, the percentages are based on the weight of the charge transporting molecules and binders and does not take into account the weight of the residual "high boiling solvent". In all of the above charge transport layers, the total weight percent of activating compounds which renders electrically inactive polymeric material electrically active is preferably between about 40 percent by weight and about 60 percent by weight, based on the total weight of the transport layer after drying. The concentration of the molecule containing two long chain alkyl groups is such that the drop in charge carrier mobility is small (less than a factor of two).

Any suitable inactive resin binder soluble in the charge transport layer coating composition solvents may be employed in the process of this invention. Typical inactive resin binders soluble in solvents include, for example, polycarbonate resin, polystyrene resins, polyether carbonate resins, polyester resins, copolyester resins, terpolyester resins, polystyrene resins, polyarylate resins and the like and mixtures thereof. Polycarbonate resins include, for example, poly(4,4'-isopropylidenediphenyl carbonate) [polycabonate A]; polyether carbonate resins; 4,4'-cyclohexylidene diphenyl polycarbonate [polycarbonate Z]; poly(4,4'-isopropylidene-3,3'-dimethyl-diphenyl-carbonate) [polycarbonate C]; poly(4,4'-diphenyl-methyl phenyl-carbonate) [polycarbonate P]; and the like. Weight average molecular weights can vary from about 20,000 to about 1,500,000.

The preferred electrically inactive resin materials are polycarbonate resins have a weight average molecular weight from about 20,000 to about 100,000, more preferably from about 50,000 to about 100,000. The materials most preferred as the electrically inactive resin material is poly (4,4'-isopropylidene-diphenylene carbonate) with a molecular weight of from about 35,000 to about 40,000 (available as Lexan 145 from General Electric Company); poly(4,4'-isopropylidene-diphenylene carbonate) with a molecular weight of from about 40,000 to about 45,000 (available as Lexan 141 from the General Electric Company); a polycarbonate resin having a molecular weight of from about 50,000 to about 100,000, (available as Makrolon from Farbenfabricken Bayer A. G.) and a polycarbonate resin having a molecular weight of from about 20,000 to about 50,000 (available as Merlon from Mobay Chemical Company). The most preferred polycarbonates resins are polycarbonate A, polycarbonate C and polycarbonate Z. Preferably, the charge transport layer comprises between about 60 percent by weight and about 40 percent by weight of film forming binder after drying.

A mixture of low boiling point and high boiling point solvents is employed to form the transport layer of this invention. Methylene chloride solvent is a desirable low boiling point component of the charge transport layer coating mixture for adequate dissolving of all the components and for its low boiling point. Because of the low boiling point of methylene chloride, it is easily removed during drying. The expression "low boiling solvent" as employed herein, is defined as those solvents having a boiling point which is at least about 10° C. lower than the typical drying temperature in the range of about 80° C. to about 125° C. The expression "High boiling temperature", as employed herein, is defined as those solvents having a boiling point which is about equal to the drying temperature or slightly or substantially higher than the drying temperature. The high boiling component in the solvent mixture for coating the transport layer is selected from the group consisting of monochlorobenzene, dichlorobenzene, trichlorobenzene, and mixtures thereof. The mixtures thereof may comprise any two or all three of the high boiling solvents. Because these solvents have a high boiling point, they evaporate slowly. The high and low boiling solvents should be miscible in each other and should also dissolve the film forming binder and charge transporting small molecule. Since the concentration of the high boiling solvent employed depends on the concentration of the charge transport molecule containing at least two long chain alkyl carboxylate groups, the concentration of high boiling point solvent in the coating mixture is adjusted for any combination of specific high boiling solvent and charge transport molecule containing at least two long chain alkyl carboxylate groups until the combination forms a transport layer that is substantially free of internal stress. The expression "substantially free of internal stress", as employed herein, is defined as lacking in unbalanced internal forces in the bulk which leads to physical distortion of materials in the transport layer. A photoreceptor comprising a transport layer free of internal stress on a supporting substrate layer will lie flat and be free of curl. When more than 10 weight percent of the transport molecule containing two long chain alkyl carboxylate groups, based on the total weight of the dried transport layer (not taking into account residual solvents), is employed, the charge carrier mobilities of the transport layer drops below the minimum value required for operation in high speed or high quality reproduction machines. A typical minimum charge carrier mobility value for high speed or high quality reproduction machines is approximately $5\times10^{-6}$ $cm^2/V$ sec. The drop in mobilities is caused by the effect of the long chains which are essentially non-charge transporting and for a given weight concentration of the transport molecules, the presence of the long chain alkyl groups reduces the number of transporting units. Also, the dipole content of the long alkyl carboxylate groups reduces the charge carrier mobilities. In the absence of the charge transport molecule containing two long chain carboxylate groups the high boiling solvent required to obtain stress free devices can be as high as 12 weight percent of the total weight of solvents required to coat the transport layer. A surprising discovery is that by adding a small concentration of the molecule containing long chain alkyl carboxylate groups, the concentration of the high boiling solvent required to produce curl free photoreceptors is very low. This is an unexpected synergistic effect. The presence of the small concentration of the charge transport molecule containing long chain alkyl groups does not adversely impact the charge carrier mobility. As an example, for a transport layer containing 45 weight percent of the conventional transport molecule and 5 weight percent of the charge transport molecule containing two long chain alkyl carboxylate group, based on the total weight of solids in the coating solution (or the solids in the dried transport layer not taking into account any residual solvent), the amount of the high boiling point solvent required to produce stress free, curl free devices is less than 3 weight percent of the total weight of all solvents. Preferably, the transport layer is coated from a mixture of between about 95 percent and about 98 percent by weight of the high boiling point solvent and between about 2 percent and about 5 percent by weight of the low boiling point solvent, based on the total weight of the solvents. The boiling point of methylene chloride is 40° C. and the boiling point of monochlorobenzene, dichlorobenzene and 1,2,4 trichlorobenzene are 131° C., 173° C. and 213° C., respectively. In order to achieve stress free films, the concentration of monochlorobenzene is from about 4 to 5 ercent by weight and the concentration of 1,2,4 trichlorobenzene is from about 2 to 3 ercent by weight, based on the weight of the solvents employed for coating the transport layer. Thus, the transport layer coating mixture should contain at least about 2 percent by weight of the chlorobenzene solvent, based on the total weight of the solvents, the amount of chlorobenzene being sufficient to form a transport layer that is substantially free of internal stress. The concentration of the dichlorobenzene lies in between about 2 percent and about 5 percent by weight based on the weight of the solvents employed to coat the transport layer. The concentration of about 2 percent to about 5 percent by weight of the "high boiling solvent" (based on the weight of the low boiling solvent) is for a material composition containing 45 percent by weight N,N'-diphenyl-N,N'-bis(3-methylphenyl)-1,1'-biphenyl)4,4' diamine (TBD) and 5 percent by weight N,N'-diphenyl-N, N'-bis {3-{oxypentyl ethylcarboxylate}phenyl}-4,4'-biphenyl-1,1' diamine (TBD-OPEC) in bisphenol-A-polycarbonate. The concentration of the "high boiling solvent" in the coating mixture depends on the glass transition temperature of the material composition of the transport layer measured in the absence of the "high boiling solvent".

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Preferably, the drying temperature should be lower than or equal to the boiling point of the "high boiling solvent" and higher than the boiling point of the "low boiling solvent". Generally, the thickness of the dried transport layer is between about 5 micrometers and about 100 micrometers, but thicknesses outside this range can also be used. Not all of the "high boiling solvent" added to the coating mixture remains in the final "dried" film. The amount of the "high boiling solvent" remaining in the final "dried" device depends on a number of factors including: (1) drying temperature, (2) percent of N,N'-diphenyl-N,N'-bis {3{oxypentyl ethylcarboxylate}phenyl}-4,4'-biphenyl-1,1' diamine (TBD-OPEC) present, (3) boiling point of the "high boiling solvent", (4) concentration of the "high boiling solvent" in the coating mixture and (5) transport layer thickness. The glass transition temperature is lowered as a result of adding the molecule with two long chain alkyl carboxylate groups and the "high boiling solvent". In order to obtain curl free devices, the glass transition temperature must be lower than about 55° C. preferably lower than 45° C. For a transport layer containing 50 percent by weight N,N'-diphenyl-N,N'-bis(3-methylphenyl)-1,1'-biphenyl)4,4' diamine (TBD) in bisphenol-A-polycarbonate coated without the "high boiling solvent", the glass transition temperature is approximately 73° C. For a transport layer containing 45 weight percent N,N'-diphenyl-N,N'-bis(3-methylphenyl)-1,1'-biphenyl)4,4' diamine (TBD) and 5 weight percent N,N'-diphenyl-N, N'-bis {3{oxypentyl ethylcarboxylate}phenyl}-4,4'-biphenyl-1,1' diamine (TBD-OPEC) in bisphenol-A-polycarbonate and coated without the "high boiling solvent", the glass transition temperature is approximately 62° C. When the latter film coated with the "high boiling solvent" (and with the concentration required to form flat, "curl free" devices), the glass transition temperature is between about 40° C. and about 45° C. The surprising synergistic effect of this invention over the prior art may be related to the large reduction in glass transition temperature, e.g., from 73° C. for a transport layer free of of the "high boiling solvent" to 62° C. by merely adding 5 weight percent of N,N'-diphenyl-N,N'-bis {3-{oxypentyl ethylcarboxylate}phenyl}-4,4'-biphenyl-1,1' diamine (TBD-OPEC), based on the total weight of solids. The presence of 5 weight percent of N,N'-diphenyl-N,N'-bis {3{oxypentyl ethylcarboxylate}phenyl}-4,4'-biphenyl-1,1' diamine (TBD-OPEC) does not reduce the charge carrier mobility.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, a thin overcoat layer may also be utilized to improve resistance to abrasion. These overcoating layers may comprise organic polymers or inorganic polymers that are electrically insulating or slightly semi-conductive.

PREFERRED EMBODIMENTS OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Six flexible photoreceptor sheets were prepared by forming coatings using conventional techniques on a substrate comprising a vacuum deposited titanium layer on a flexible polyethylene terephthalate film having a thickness of 3 mil (76.2 micrometers). The first coating was a siloxane barrier layer formed from hydrolyzed gamma aminopropyltriethoxysilane having a thickness of 0.005 micrometer (50 Angstroms). This layer was coated from a mixture of 3-aminopropyltriethoxysilane (available from PCR Research Chemicals of Florida) in ethanol in a 1:50 volume ratio. The coating was applied to a wet thickness of 0.5 mil by a multiple clearance film applicator. The coating was then allowed to dry for 5 minutes at room temperature, followed by curing for 10 minutes at 110 degree centigrade in a forced air oven. The next applied coating was an adhesive layer of polyester resin (49,000, available from E. I. duPont de Nemours & Co.) having a thickness of 0.005 micrometer (50 Angstroms) and was coated from a mixture of 0.5 gram of 49,000 polyester resin dissolved in 7.0 grams of tetrahydrofuran and 29.5 grams of cyclohexanone. The coating was applied by a 0.5 mil bar and cured in a forced air oven for 10 minutes. This adhesive interface layer was thereafter coated with a photogenerating layer (CGL) containing 40 percent by volume hydroxygallium phthalocyanine and 60 percent by volume copolymer polystyrene (82 percent)/poly4-vinyl pyridine (18 percent) with a Mw of 11,000. This photogenerating coating mixture was prepared by introducing 1.5 grams polystyrene/poly4-vinyl pyridine and 42 ml of toluene into a 4 oz. amber bottle. To this solution was added 1.33 grams of hydroxygallium phthalocyanine and 300 grams of ⅛ inch diameter stainless steel shot. This mixture was then placed on a ball mill for 20 hours. The resulting slurry was thereafter applied to the adhesive interface with a Bird applicator to form a layer having a wet thickness of 0.25 mil. The layer was dried at 1 35° C. for 5 minutes in a forced air oven to form a dry thickness photogenerating layer having a thickness of 0.4 micrometer.

Six coated members prepared as described above were coated with charge transport layers containing N,N'-diphenyl-N,N'-bis(3-methyl-phenyl)-(1,1 'biphenyl)4,4'-diamine (TBD) and N,N'-diphenyl-N,N'-bis{3-{oxypentyl ethylcarboxylate}phenyl}-4,4'-biphenyl-1,1' diamine (TBD-OPEC) molecularly dispersed in a polycarbonate resin [poly (4,4'-isopropylidene-diphenylene carbonate)] available as Makrolon® from Farbenfabricken Bayer A. G.]. The first four transport layers were coated using methylene chloride only. The fifth and sixth devices were coated from a mixture of methylene chloride and trichlorobenzene. First 1.2 grams of polycarbonate polymer was dissolved in 13.2 grams of the solvent to form a polymer solution. X grams of TBD and Y grams of TBD-OPEC were dissolved in the polymer solution. The charge transport layer coatings were formed using a Bird coating applicator. The N,N'-diphenyl-N,N'-bis(3-methyl-phenyl)-(1,1'biphenyl)4,4'-diamine (TBD) and N,N'-diphenyl-N,N'-bis{3{oxypentyl ethylcarboxylate}phenyl}-4,4'-biphenyl-1,1' diamine (TBD-OPEC) are electrically active aromatic diamine charge transport small molecule whereas the polycarbonate resin is an electrically inactive film forming binder. Each of the coated devices were dried at 80° C. for half an hour in a forced air oven to form a 25 micrometer thick charge transport layer on the coated members. The compositions of six transport layers on the coated members and the amount of trichlorobenzene used to coat the transport layers are shown in Table 1 below. The last column gives the concentration of 1,2 4 trichlorobenzene in weight percent. The rest of the solvent in the coating mixture is methylene chloride. The concentration of methylene chloride employed, in weigh percent, is the difference between 100 and the number appearing in the last column:

TABLE 1

| Device # | Poly-carbonate | TBD (X) | TBD-OPEC (Y) | Trichloroben-zene |
|---|---|---|---|---|
| 1 | 1.2 grams | 1.2 grams | | 0% |
| 2 | 1.2 grams | | 1.2 grams | 0% |
| 3 | 1.2 grams | 0.96 gram | 0.374 gram | 0% |
| 4 | 1.2 grams | 1.08 grams | 0.12 gram | 0% |
| 5 | 1.2 grams | 1.08 grams | 0.12 gram | 2% |
| 6 | 1.2 grams | 1.08 grams | 0.12 gram | 3% |

EXAMPLE II

The six flexible photoreceptor sheets prepared as described in Example I were tested for flatness by placing them in an unrestrained condition on a flat surface. Photoreceptor device No. 1 and 4 curled upwardly into a small diameter roll. Devices No. 2,3,5 and 6 laid flat. No curl was observed in these five flexible photoreceptor sheets.

EXAMPLE III

The flexible photoreceptor sheets prepared as described in Example I were tested for their xerographic sensitivity and cyclic stability. Each photoreceptor sheet to be evaluated was mounted on a cylindrical aluminum drum substrate which was rotated on a shaft. The device was charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed by a light source located at a position near the drum downstream from the corotron. As the drum was rotated, the initial (pre exposure) charging potential was measured by voltage probe 1. Further rotation lead to the exposure station, where the photoreceptor device was exposed to monochromatic radiation of known intensity. The device was erased by a light source located at a position upstream of charging. The measurements made included charging of the photoconductor device in a constant current or voltage mode. The device was charged to a negative polarity corona. As the drum was rotated, the initial charging potential was measured by voltage probe 1. Further rotation lead to the exposure station, where the photoreceptor device was exposed to monochromatic radiation of known intensity. The surface potential after exposure was measured by voltage probes 2 and 3. The device was finally exposed to an erase lamp of appropriate intensity and any residual potential was measured by voltage probe 4. The process was repeated with the magnitude of the exposure automatically changed during the next cycle. The photodischarge characteristics was obtained by plotting the potentials at voltage probes 2 and 3 as a function of light exposure. The charge acceptance and dark decay were also measured in the scanner. The PhotoInduced Discharge characteristics (PIDC) and the cyclic stability of all the six devices were essentially equivalent.

EXAMPLE IV

Charge carrier mobilities were measured as follows in the six devices of Example 1. A vacuum chamber was employed to deposit a semitransparent gold electrode on top of each device. The resulting sandwich device was connected to an electrical circuit containing a power supply and a current measuring resistance. The transit time of the charge carriers was determined by the time of flight technique. This was accomplished by biasing the gold electrode negative and exposing the device to a brief flash of light. Holes photogenerated in the generator layer of hydroxy gallium phthalocyanine generator layers were injected into and transited through the transport layer. The current due to the transit of a sheet of holes was time resolved and displayed on an oscilloscope. The current pulse displayed on the oscilloscope comprised a curve having flat segment followed by a rapid decrease. The flat segment was due to the transit of the sheet of holes through the transport layer. The rapid drop of current signaled the arrival of the holes at the gold electrode. From the transit time, the velocity of the carriers was calculated by the relationship:

velocity=transport layer thickness/transit time

The hole mobility is related to the velocity by the relationship:

velocity=(mobility)×(electric field)

The mobility of the six devices at an applied electric field of 2×105 V/cm is shown in Table 2 below:

TABLE 2

| Device # | Hole mobility ($cm^2$/V sec) |
|---|---|
| 1 | $1 \times 10^{-6}$ |
| 2 | $4 \times 10^{-5}$ |
| 3 | $3 \times 10^{-6}$ |
| 4 | $1 \times 10^{-5}$ |
| 5 | $1 \times 10^{-5}$ |
| 6 | $1 \times 10^{-5}$ |

There is very little loss in mobility in the devices of this invention (devices 5 and 6) as compared to the devices which contain the combination of conventional electrically active charge transport small molecule, charge transporting material containing long chain alkyl carboxylate groups in a concentration required to form curl free films in a film forming binder and no high boiling point solvent (devices #2 and 3).

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate and at least one imaging layer comprising a first charge transport material and a different second charge transporting material dissolved or molecularly dispersed in a film forming binder and a high bolling point solvent, said at least one imaging layer having been formed by drying at a predetermined drying temperature a coating comprising a solution of said first and second charge transporting materials and said film forming polymer binder in a mixture of a low boiling point solvent and said high boiling point solvent, said high boiling point solvent having a boiling point at least about said drying temperature and said low boiling point solvent having a boiling point at least about 10° C. lower than said drying temperature whereby residual us high boiling solvent remains in said at least one imaging layer after said drying, said solution comprising between about 60 percent by weight and about 40 percent by weight of said film forming binder and between about 3 percent and about 10 percent by weight of said second charge transport material and between about 37 percent by weight and about 50 percent by weight said first charge transport molecule, all based on the total weight of solids in said solution, said second transporting material is derived from a charge transporting reactant selected from the group consisting of a tertiary amine containing molecules and represented by the formula:

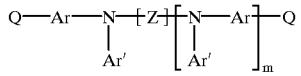

m is 0 or 1,

Z is selected from the group consisting of:

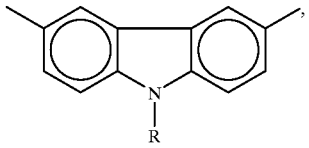

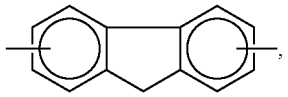

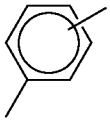

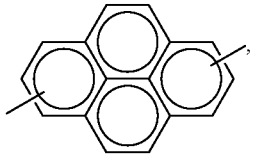

and

-continued

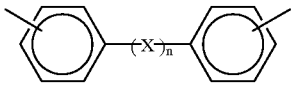

n is 0 or 1,

Ar is selected from the group consisting of:

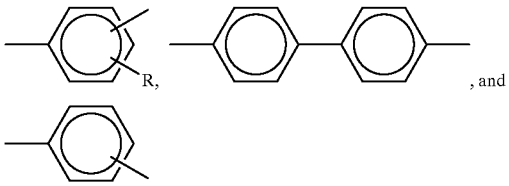

R is selected from the group consisting of —$CH_3$, —$C_2H_5$, —$C_3H_7$, and —$C_4H_9$, Ar' is selected from the group consisting of;

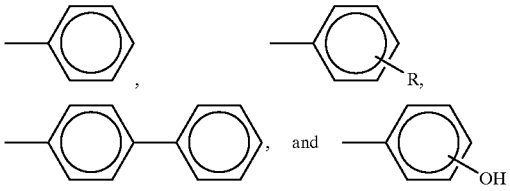

X is selected from the group consisting of:

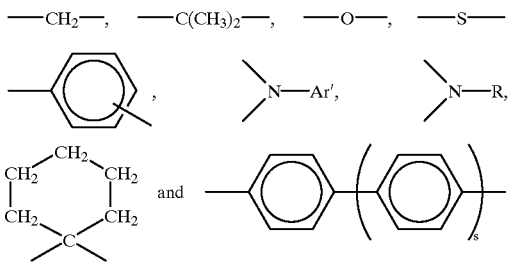

s is 0,1 or 2, and

Q is represented by the formula:

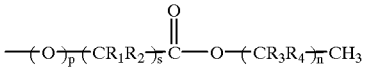

wherein:

p is 1 or 0

$R_1$, $R_2$, $R_3$, $R_4$ are independently selected from —H, —$CH_3$,—$(CH_2—)_vCH_3$,—$CH(CH_3)_2$,—$C(CH_3)_3$ wherein v is 1 to 10, and s and n are independently selected from 0 to 10, and said first charge transport material is an aromatic amine compound having the general formula:

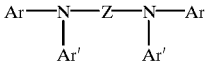

wherein:

Z is selected from the group consisting of:

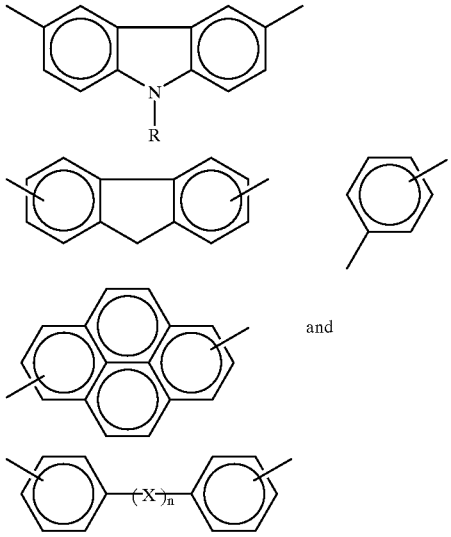

n is 0 or 1,

Ar is selected from the group consisting of:

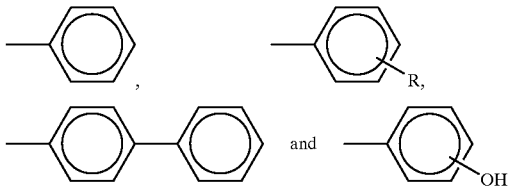

R is selected from the group consisting of —$CH_3$, —$C_2H_5$, —$C_3H_7$, and —$C_4H_9$, Ar' is selected from the group consisting of;

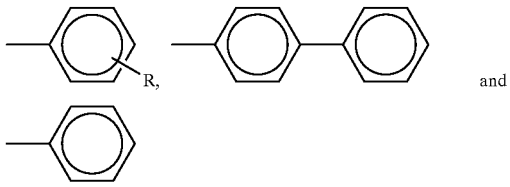

X is selected from the group consisting of:

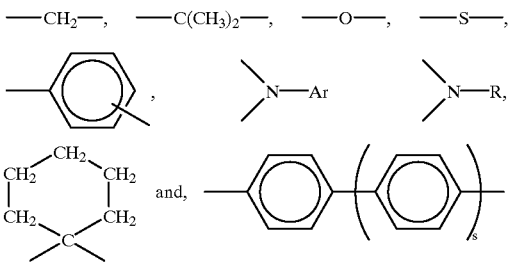

s is 0, 1 or 2.

2. An electrophotographic imaging member according to claim 1 wherein said second charge transporting material is an ethylcarboxylate diamine.

3. An electrophotographic imaging member according to claim 2 wherein said at lea st one imaging layer comprises a charge generating layer and a charge transport layer, said charge transport layer comprising between about 60 percent by weight and about 40 percent by weight of said film forming binder and between about 3 percent and about 10 percent by weight of said ethylcarboxylate diamine and between about 37 percent by weight and about 50 percent by weight said first charge transport molecule, all based on the total weight of solids in the coating solution.

4. An electrophotographic imaging member according to claim 3 wherein said transport layer is coated from a mixture of between about 95 to about 98 percent of the low boiling solvent and between about 2 percent and about 5 percent by weight of said high boiling solvent, based on the total weight of said solvents in the coating solution.

5. An electrophotographic imaging member according to claim 3 wherein said ethylcarboxylate diamine is N,N'-diphenyl-N,N'-bis{3-{oxypentyl ethylcarboxylate}phenyl}-4,4"-biphonyl-1,1" diamine.

6. An electrophotographic imaging member according to claim 3 wherein said first charge transport material is N,N'-diphenyl-N,N'-bis(3-methyl-phenyl)-(1,1'biphenyl)-4,4'-diamine.

7. An electrophotographic imaging member according to claim 3 wherein the said low boiling point solvent is methylene chloride.

8. An electrophotographic imaging member according to claim 3 wherein the said high boiling solvent is selected from the group consisting of monochlorobenzene, dichiorobenzene, 1,2,4 trichlorobenzene and mixtures thereof.

9. An electrophotographic imaging member according to claim 3 wherein said supporting substrate comprises polyethylene terephthalate.

10. An electrophotographic imaging member according to claim 3 wherein said transport layer is substantially tree of internal stress.

11. An electrophotographic imaging member according to claim 3 wherein said film forming binder comprises a polycarbonate.

12. An electrophotographic imaging member according to claim 11 wherein said polycarbonate is selected from the group consisting of polycarbonate A, polycarbonate C and polycarbonate Z.

13. An electrophotographic imaging member according to claim 1 wherein said supporting substrate is uncoated on one side and coated on the opposite side with said least one imaging layer.

14. An electrophotographic imaging member comprising a substrate, a charge generating layer, a charge transport layer comprising a first charge transport material and a different second charge transporting material dissolved or molecularly dispersed in a film forming binder and a high boiling point solvent, said transport layer having been formed by drying a coating comprising a solution of said first and second charge transporting materials and said film forming polymer binder in a mixture of a low boiling point solvent and said high boiling point solvent, said high boiling point solvent having a boiling point at least about said drying temperature and said low boiling point solvent having a boiling point at least about 10° C. lower than said drying temperature whereby residual high boiling solvent remains in said charge transport layer after said drying, and said charge transport layer comprising between about 60 percent by weight and about 40 percent by weight of said film forming binder and between about 3 percent and about 10 percent by weight of said second charge transporting material and between about 37 percent by weight and about 50 percent by weight said first charge transport molecule, all based on the total weight of solids in the coating solution, said second transporting material is derived from a charge transporting reactant selected from the group consisting of a tertiary amine containing molecules and represented by the formula:

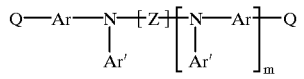

m is 0 or 1,

Z is selected from the group consisting of:

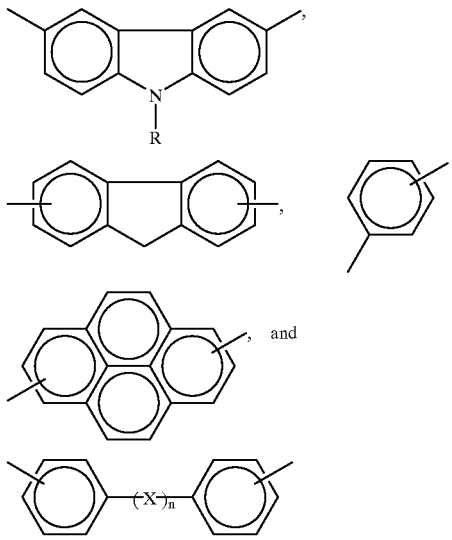

n is 0 or 1,

Ar is selected from the group consisting of:

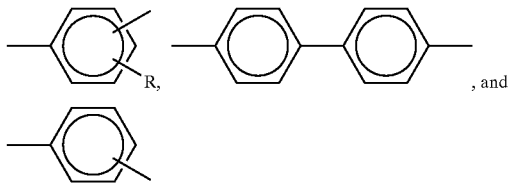

R is selected from the group consisting of —$CH_3$, —$C_2H_5$, —$C_3H_7$, and —$C_4H_9$, Ar' is selected from the group consisting of:

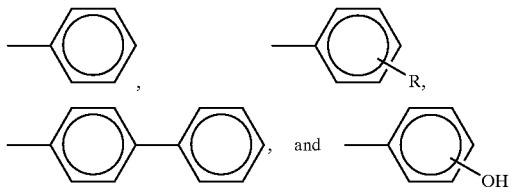

X is selected from the group consisting of:

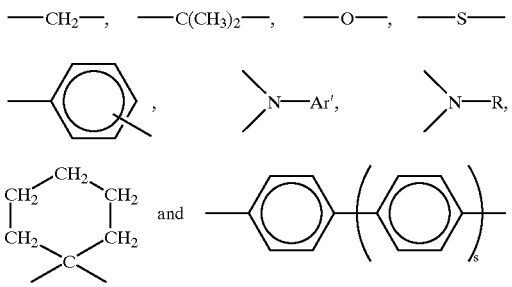

s is 0, 1 or 2, and

Q is represented by the formula:

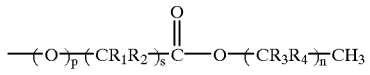

wherein:

p is 1 or 0

$R_1$, $R_2$, $R_3$, R4 are independently selected from —H, —$CH_3$, —$(CH_2—)_vCH_3$,—$CH(CH_3)_2$,—$C(CH_3)_3$ wherein v is 1 to 10, and s and n are Independently selected from 0 to 10, and said first charge transport material is an aromatic amine compound having the general formula:

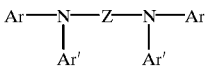

wherein:

Z is selected from the group consisting of;

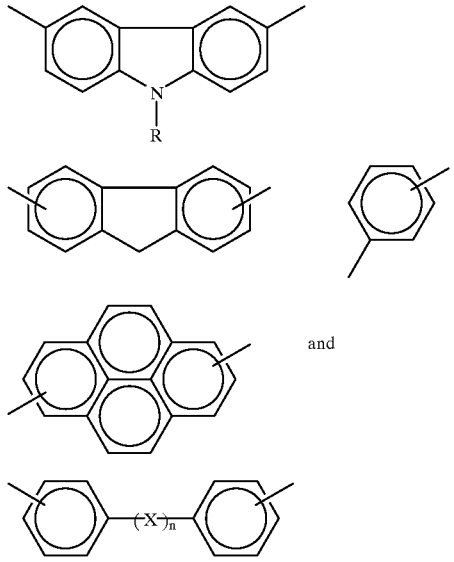

n is 0 or 1,

Ar is selected from the group consisting of:

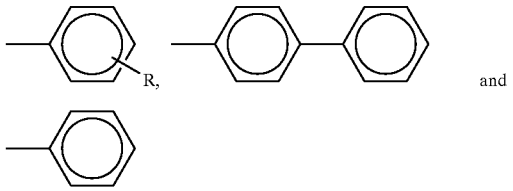

R is selected from the group consisting of —$CH_3$, —$C_2H_5$, —$C_3H_7$, and —$C_4H_9$, Ar' is selected from the group consisting of:

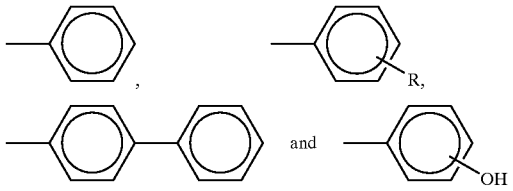

X is selected from the group consisting of:

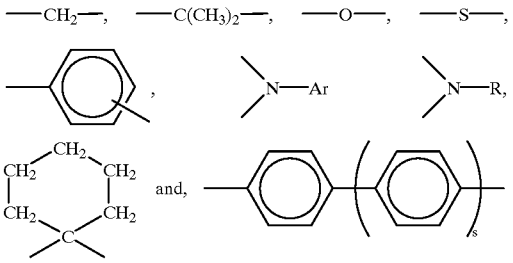

s is 0, 1 or 2.

15. A process for fabricating an electrophotographic imaging member comprising providing a substrate, forming a charge generating layer on said substrate, and applying to said charge generating layer a coating comprising a solution of an electrically active first charge transport material, a different electrically active charge transporting material, a polymer binder, a low boiling point solvent and a high boiling point solvent, and drying said coating to form a dried charge transport layer comprising said electrically active first charge transport material and said different electrically active charge transporting material dissolved or molecularly dispersed in said polymer binder and said high boiling point solvent, and said charge transport layer comprising between about 60 percent by weight and about 40 percent by weight of said film forming binder and between about 3 percent and about 10 percent by weight of said different electrically active charge transporting material and between about 37 percent by weight and about 50 percent by weight said first charge transport molecule, all based on the total weight of solids in said coating solution, said different electrically active charge transporting material is derived from a charge transporting reactant selected from the group consisting of a tertiary amine containing molecules and represented by the formula:

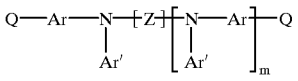

m is 0 or 1,

Z is selected from the group consisting of:

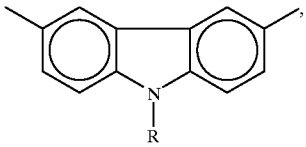

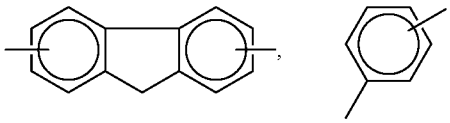

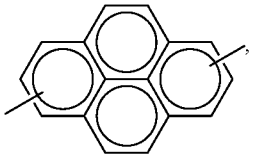

and

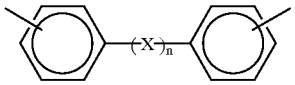

n is 0 or 1,

Ar is selected from the group consisting of:

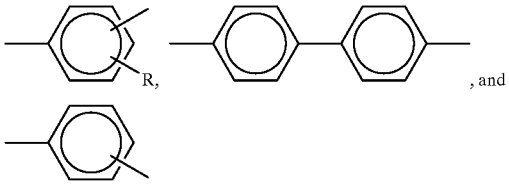

, and

R is selected from the group consisting of —$CH_3$, —$C_2H_5$, —$C_3H_7$, and —$C_4H_9$, Ar' is selected from the group consisting of:

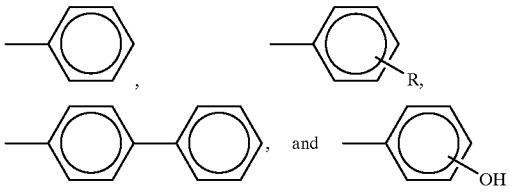

X is selected from the group consisting of:

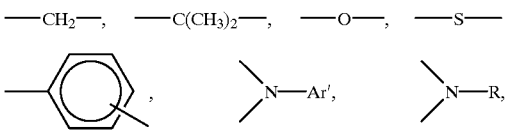

-continued

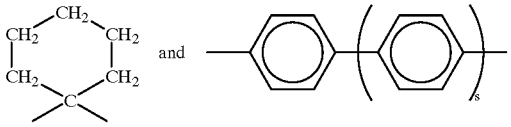

s is 0, 1 or 2, and

Q is represented by the formula:

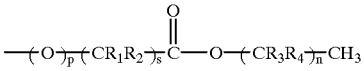

wherein:

p is 1 or 0

$R_1$, $R_2$, $R_3$, R are independently selected from —H, —$CH_3$,—$(CH_2—)_vCH_3$,—$CH(CH_3)_2$,—$C(CH_3)_3$ wherein v is 1 to 10, and s and n are independently selected from 0 to 10, and said first charge transport material is an aromatic amine compound having the general formula:

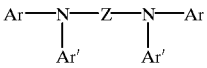

wherein:

Z is selected from the group consisting of:

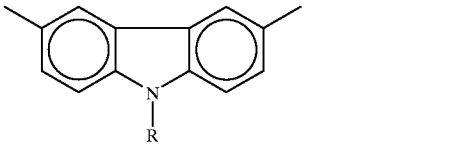

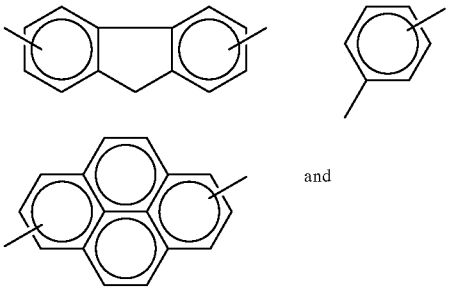

and

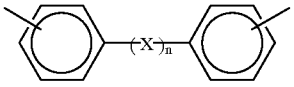

n is 0 or 1,

Ar is selected from the group consisting of:

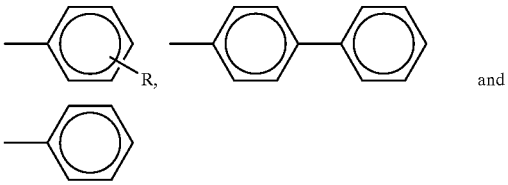

and

R is selected from the group consisting of —$CH_3$, —$C_2H_5$, —$C_3H_7$, and —$C_4H_9$, Ar' is selected from the group consisting of:

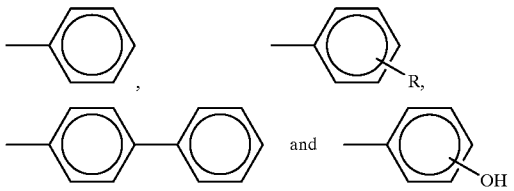

X is selected from the group consisting of:

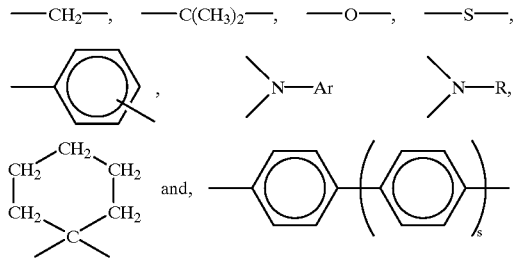

s is 0, 1 or 2.

16. A process according to claim 15 wherein said drying includes heating said coating to a temperature between the boiling point temperature of said low boiling point solvent and the boiling temperature of said high boiling point solvent.

17. An electrophotographic imaging member according to claim 15 wherein said transport layer after drying has a glass transition temperature of between about 40° C. and about 55° C.

18. An electrophotographic imaging member according to claim 17 wherein said transport layer after drying has a glass transition temperature of between 40° C. about 45° C.

19. A process according to claim 15 wherein said low boiling point solvent is methylene chloride.

20. A process according to claim 15 wherein said high boiling point solvent is selected from the group consisting of monochlorobenzene, dichlorobenzene, 1,2,4 trichlorobenzene and mixtures thereof.

21. A process for fabricating an electrophotographic imaging member comprising providing a substrate, forming a charge generating layer on said substrate, and applying to said charge generating layer a coating comprising a solution of an electrically active first charge transport material, a different electrically active charge transporting material, a polymer binder, a low boiling point solvent and a high boiling point solvent, and drying said coating to form a dried charge transport layer comprising said electrically active first charge transport material and said different electrically active charge transporting material dissolved or molecularly dispersed in said polymer binder and said high boiling point solvent, said charge transport layer comprising between about 60 percent by weight and about 40 percent by weight of said film forming binder and between about 3 percent and about 10 percent by weight of said different electrically active charge transporting material and between about 37 percent by weight and about 50 percent by weight said first charge transport molecule, all based on the total weight of solids in said coating solution, said solution comprising between about 95 percent and about 98 percent by weight of said high boiling point solvent and between about 2 percent and about 5 percent by weight of said low boiling point solvent, based on the total weight of the solvents, said "different electrically active charge", transporting material is derived from a charge transporting reactant selected from the group consisting of a tertiary amine containing molecules and represented by the formula:

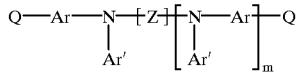

m is 0 or 1,

Z is selected from the group consisting of:

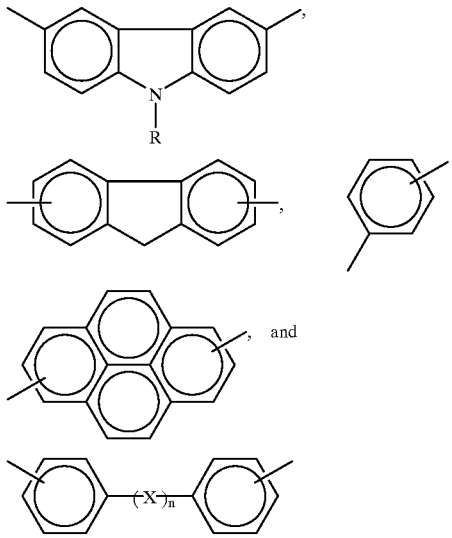

n is 0 or 1,

Ar is selected from the group consisting of:

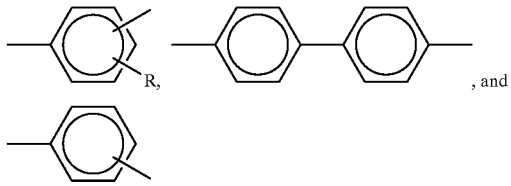

R is selected from the group consisting of —$CH_3$, —$C_2H_5$, —$C_3H_7$, and —$C_4H_9$, Ar' is selected from the group consisting of:

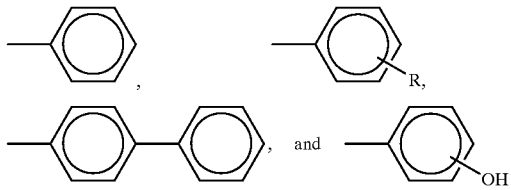

X is selected from the group consisting of:

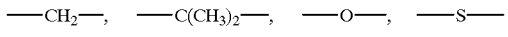

-continued

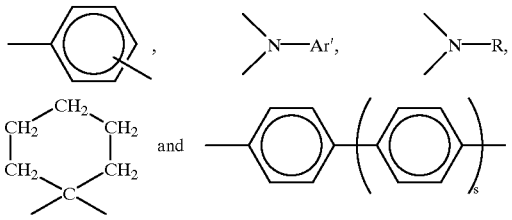

s is 0, 1 or 2, and

Q is represented by the formula:

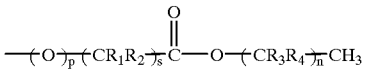

wherein:

p is 1 or 0

$R_1$, $R_2$, $R_3$, $R_4$ are independently selected from —H, —$CH_3$,—$(CH_2—)_vCH_3$,—$CH(CH_3)_2$,—$C(CH_3)_3$ wherein v is 1 to 10, and s and n are independently selected from 0 to 10, and said first charge transport material is an aromatic amine compound having the general formula:

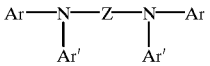

wherein;

Z is selected from the group consisting of:

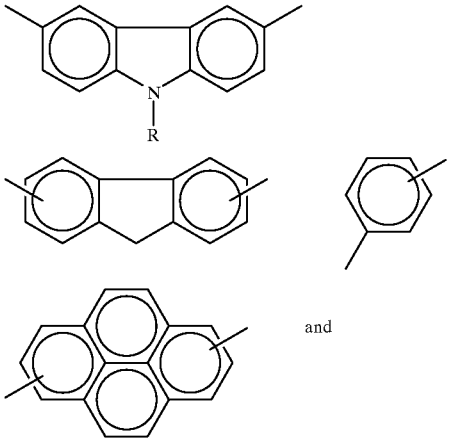

-continued

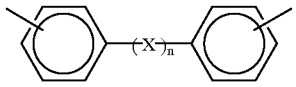

n is 0 or 1,

Ar is selected from the group consisting of:

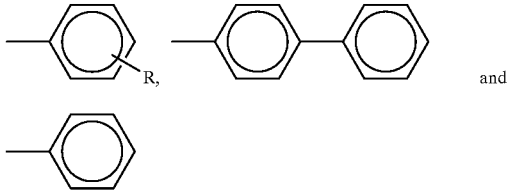

R is selected from the group consisting of —$CH_3$, —$C_2H_5$, —$C_3H_7$, and —$C_4H_9$, Ar' is selected from the group consisting of:

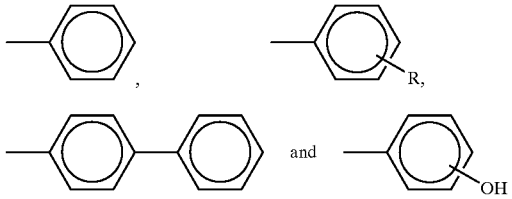

X is selected from the group consisting of:

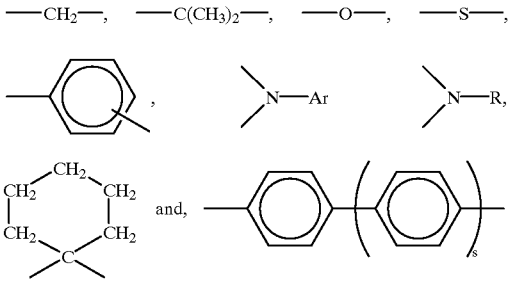

s is 0,1 or2.

* * * * *